US009282597B2

(12) United States Patent
Manor

(10) Patent No.: US 9,282,597 B2
(45) Date of Patent: Mar. 8, 2016

(54) DEVICE AND METHOD FOR CONTROLLED LED LIGHTING

(71) Applicant: Magnitude Lighting Transformers Inc., Tustin, CA (US)

(72) Inventor: Dror Manor, Herzliya (IL)

(73) Assignee: Magnitude Holdings Ltd., A Bermuda Exempt Company Limited By Shares, Boston, MA (US)

( * ) Notice: Subject to any disclaimer, the term of this patent is extended or adjusted under 35 U.S.C. 154(b) by 0 days.

(21) Appl. No.: 14/201,967

(22) Filed: Mar. 10, 2014

(65) Prior Publication Data

US 2014/0312782 A1 Oct. 23, 2014

Related U.S. Application Data

(60) Provisional application No. 61/807,339, filed on Apr. 2, 2013.

(51) Int. Cl.
*H05B 37/02* (2006.01)
*H05B 33/08* (2006.01)

(52) U.S. Cl.
CPC ..... *H05B 33/0803* (2013.01); *H05B 37/02* (2013.01)

(58) Field of Classification Search
CPC ..... H05B 37/00; H05B 37/02
USPC ..... 315/291, 294, 297, 307, 308, 312
See application file for complete search history.

(56) References Cited

U.S. PATENT DOCUMENTS

| | | | | |
|---|---|---|---|---|
| 2004/0085030 | A1* | 5/2004 | Laflamme | H05B 33/0863 315/291 |
| 2006/0261754 | A1* | 11/2006 | Lee | H05B 33/0815 315/291 |
| 2007/0206370 | A1 | 9/2007 | Crunk | |
| 2009/0302783 | A1 | 12/2009 | Wang et al. | |
| 2010/0244727 | A1 | 9/2010 | Ye et al. | |
| 2012/0181935 | A1* | 7/2012 | Velazquez | 315/132 |
| 2012/0293083 | A1 | 11/2012 | Miskin et al. | |
| 2013/0069561 | A1* | 3/2013 | Melanson et al. | 315/297 |
| 2013/0175931 | A1* | 7/2013 | Sadwick | 315/158 |
| 2013/0307434 | A1* | 11/2013 | Zhang et al. | 315/219 |

* cited by examiner

*Primary Examiner* — Tung X Le
(74) *Attorney, Agent, or Firm* — Edward Langer

(57) ABSTRACT

Controlled Light Emitting Diode (LED) driver comprising an AC/DC converter configured to convert an AC voltage at its input to a DC voltage at its output; at least one LED driver coupled to the output of the AC/DC converter and configured to convert the DC voltage to a pulsed output power for driving one or more LEDs that serve to provide lighting; and a local controller having a control interface. The control interface is configured to receive control information from one or more control sources coupled to it, and the local controller is further coupled to the at least one LED driver for controlling its operation by determining one or more LED driving parameters of the pulsed output power, based on the control information.

45 Claims, 2 Drawing Sheets

DEVICE AND METHOD FOR CONTROLLED LED LIGHTING

FIELD OF THE INVENTION

The present invention relates generally to lighting systems, and particularly to methods and systems of controlled LED lighting.

BACKGROUND OF THE INVENTION

Light Emitting Diodes (LED)s have become a prevailing technology in the industry of lighting. However, an efficiently and flexibly controlled LED driving method and system is missing in the art.

SUMMARY OF THE INVENTION

Accordingly, it is a principal object of the present invention to provide improved methods and systems of controlled driving of LEDs. Thus, in accordance with an embodiment of the present invention, there is provided a Controlled Light Emitting Diode (LED) Driver comprising:

an AC/DC converter configured to convert an AC voltage at its input to a DC voltage at its output; at least one LED driver coupled to the output of the AC/DC converter and configured to convert the DC voltage to a pulsed output power for driving one or more LEDs that serve to provide lighting; and a local controller having a control interface for receiving control information from one or more control sources coupled to it. The local controller is coupled to the at least one LED driver and controls its operation by determining one or more LED driving parameters of the pulsed output power, based on the control information.

In an embodiment, a LED driver may operate as a voltage source or a current source. Principal LED driving parameters are maximum output power and output power duty cycle. A Pulse Width Modulation mechanism in the LED driver sets the duty cycle so as to result in a required LED lighting intensity.

In some embodiments, the LEDs are colored, and controlling the operation of the LED drivers comprises adjusting the pulsed output power of each of them so as to achieve a required resultant lighting color.

In an embodiment, the AC voltage is supplied by an external dimmer having a dimming angle, which the local controller senses and determines accordingly a maximum lighting intensity.

In embodiments of the present invention, various sensors are used for supplying control information to the local controller, either directly or through a remote controller. Examples of such sensors are: a motion detector, a light detector and a video camera. A sensor can be located close to the local controller and typically connected to it with a wire connection, or it can be remotely located and typically connected to it through a wireless link. The wireless link typically supports multiple access of control sources and in some embodiments it also supports a secure access.

In some embodiments, additional control sources can be used such as an external dimmer, a music player, a human voice and a smartphone.

In an embodiment, the local controller is further configured to send status information to the remote controller. Such status information may comprise command acknowledgement, the AC voltage dimming angle, parameters of the pulsed output power and output signaling of some control sources.

In accordance with an embodiment of the present invention, there is provided also a method of controlled LED driving comprising the steps of:

converting an AC voltage to a DC voltage; converting the DC voltage to one or more pulsed output power signals for driving one or more LEDs; receiving control information from one or more control sources; and determining one or more parameters of the pulsed output power signals based on the control information.

BRIEF DESCRIPTION OF THE DRAWINGS

The present invention will be more fully understood from the following detailed description of the embodiments thereof, taken together with the drawings in which.

DETAILED DESCRIPTION OF EMBODIMENTS

Embodiments of the present invention provide improved systems and methods for controlled driving of LEDs. In particular, the disclosed techniques help to provide efficient LED lighting in a given space, by controlling various LED driving parameters based on a variety of control sources, including sensors, which sense various environmental parameters such as lighting and motion in the vicinity of the LEDs.

Figure 1:
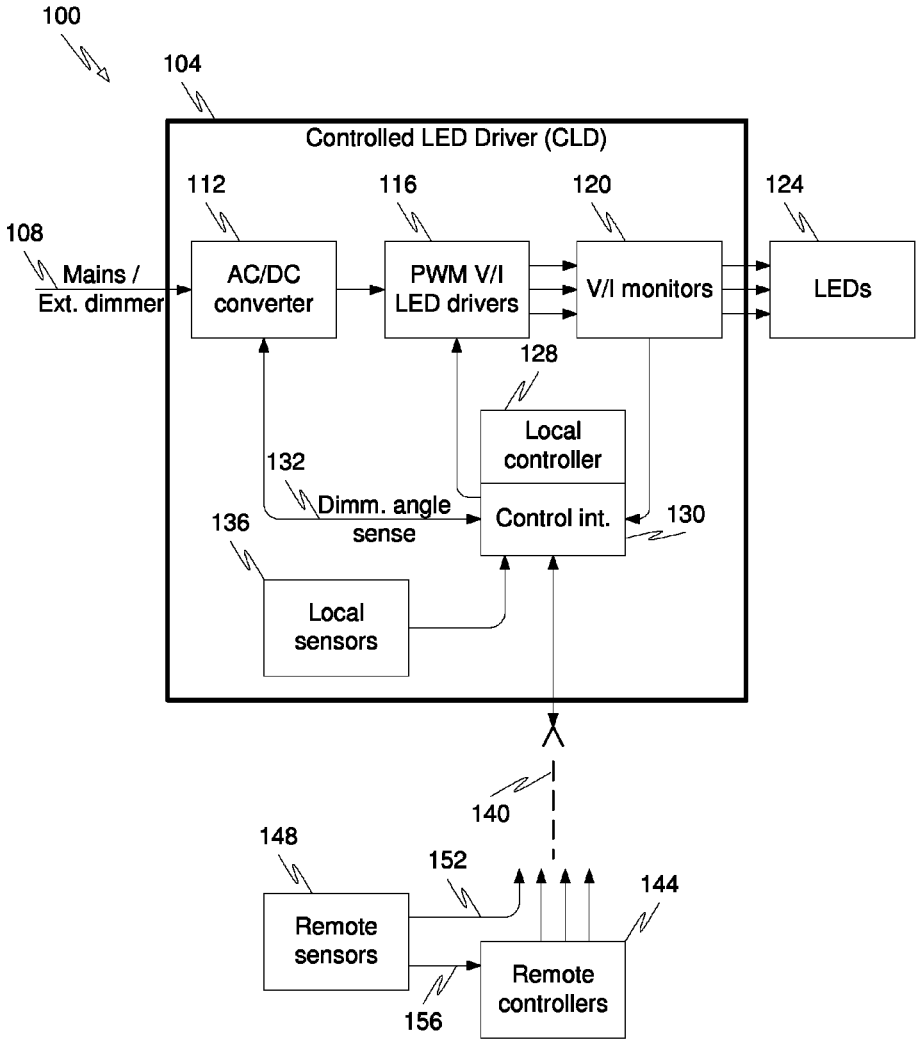
FIG. 1 is a block diagram that schematically illustrates a controlled LED driver, in accordance with an embodiment of the present invention.

Referring to FIG. 1 there is shown a block diagram 104 of a controlled LED driver (CLD) operating within a lighting system 100, in accordance with an embodiment of the present invention. CLD 104 is connected to an AC voltage 108, which is, in an embodiment, a mains output. In another embodiment, AC voltage 108 is an output of an external dimmer having a dimming angle. An AC/DC converter 112 converts AC voltage 108 to a DC voltage at its output. A LED drivers block 116 that follows, comprises one or more LED drivers, wherein each driver may constitute at its output either a voltage source or a current source. A V/I monitoring circuitry 120 that follows is explained below.

A LEDs block 124, which is, in an embodiment, external to CLD 104, typically comprises one or more LED chains coupled to LED drivers 116 and serve to provide lighting of a given space in the vicinity of LEDs 124. A LED driver 116 outputs a pulsed output power whose duty-cycle is modulated by a Pulse Width Modulation (PWM) technique for achieving a required lighting intensity. The amplitude of the pulsed output power is typically determined by LEDs 124 specification. V/I monitoring circuitry 120 coupled to LEDs 124 constitutes a monitoring means of the driving voltage and current supplied by each LED driver 116 to each LED chain 124.

A local controller 128 monitors and controls the operation of the aforementioned blocks through a control interface 130. In particular, local controller 128 controls driving parameters of LEDs 124, such as the duty-cycle and amplitude of the pulsed power at the output of each LED driver 116, for achieving required lighting of LEDs 124, based on control information received from various control sources that are described below.

In some embodiments, wherein AC voltage 108 is an output of an external dimmer, AC/DC converter 112 also constitutes a control source for local controller 128 by detecting the AC voltage dimming angle and providing this control information to local controller 128 through line 132. The local controller then determines accordingly the duty-cycle at the output of LED drivers 116.

In an alternative embodiment, wherein the lighting intensity is determined by a control source other than AC/DC converter 112, as described below, the local controller determines a maximum lighting intensity based on the dimming angle, so as to limit peak currents within AC/DC converter 112.

The control information flow on the inverse direction of line 132 serves local controller 128 for controlling the operation of AC/DC converter 112, e.g. turning it to idle mode when no lighting power is required.

In an embodiment, one or more remote controllers 144 constitute a control source for local controller 128 via control interface 130. As an example, remote controller 144 can be a smartphone, by which a user can command local controller 128 to turn on, turn off or dim LEDs 124. A user, or a computer application in remote controller 144, can, in the same manner, command any other characteristics of LEDs 124 lighting, e.g. a resultant color, as explained below. A link 140, which connects remote controller 144 to local controller 128 through control interface 130 within CLD 104, is typically a wireless link supporting one or more multiple access protocols. However, in some embodiments a wired link 140 may be used as well.

In an embodiment, link 140 is made bidirectional, thereby allowing local controller 128 to provide remote controller 144 with status information. Such status information typically comprises command acknowledgement, the dimming angle value if available, monitored parameters of the pulsed output power such as duty-cycle and amplitude, output signaling of control sources of local controller 128, specifically output signaling of sensors which are described below and the like.

In some embodiments, wherein remote controller 144 receives from local controller 128 the dimming angle detected by AC/DC converter 112, remote controller 144 determines the maximum lighting intensity, based on the dimming angle, instead of local controller 128.

In some embodiments, control interface 130 comprises an audio interface thereby allowing users to provide local controller 128 with control information in the form of vocal commands. In some embodiments, the above audio interface is adapted to receive control information in the form of sounds, specifically music coming from a music player or from playing music instruments, while local controller 128 is configured to vary LEDs 124 driving parameters according to the music played. In such an embodiment, LEDs 124 are typically colored with various colors, and controller 128 varies the driving parameters at the output of LED drivers 116 so as to provide variable lighting color and intensity synchronized with the music played.

In some embodiments, various types of sensors are used as control sources for local controller 128. Such sensors may be packaged within CLD 104, as depicted by local sensors 136 in FIG. 1, or located externally to the CLD as depicted by remote sensors 148. Local sensors 136 typically pass their output signaling to control interface 130 through a wire connection. Remote sensors 148 are typically coupled to control interface 130 through wireless link 140.

In an embodiment, a motion detection sensor indicates to local controller 128, upon detecting motion, that it should intensify the lighting level of LEDs 124 through LED drivers 116. As another example, a light detector sensor serves to measure and to indicate to local controller 128 the actual lighting intensity and optionally, the color of LEDs 124. Local controller 128 then adjusts the driving parameters at the output of LED drivers 116 so as to achieve a required lighting based on the light detector output signaling.

In an embodiment, a remote sensor 148 can send its output signaling to any of the local and remote controllers 128 and 144 respectively, as shown in FIG. 1. The choice of the specific signaling path determines the way each of the controllers handles the sensor's output signaling and, in general, the partition of intelligence between both controllers.

A remote sensor 148 may be, for example, a photographic means such as a video camera. In this case the video camera sends variable photographic information directly to local controller 128 as depicted by line 152 in FIG. 1. This photographic information typically comprises a stream of photos of a space in the vicinity of LEDs 124. In an embodiment, a pattern recognition software within local controller 128 is programmed to apply lighting through LED drivers 116, as explained above, to any part of the space upon detecting motion in that part.

In another embodiment, local controller 128 analyses the actual lighting in various parts of the space and adjusts LED drivers 116 to provide required lighting characteristics in those parts, based on the analysis. In yet another embodiment, the video camera sends the above photo stream to remote controller 144, as depicted by line 156. In this case the above motion detection and/or lighting analysis is done in the remote controller. The remote controller then converts the analysis results to commands containing lighting parameters and sends these commands to local controller 128 through link 140.

In an embodiment, local controller 128 typically comprises a programmable processor, which is programmed in software to carry out the functions described herein. Software updates as well as required lighting characteristics may be downloaded to local controller 128 through link 140. In some embodiments link 140 comprises a secure access to avoid false or malicious control of CLD 104.

The above description has focused on the specific elements of CLD 104 and lighting system 100 that are essential for understanding certain features of the disclosed techniques. Conventional elements of CLD 104 that are not needed for this understanding have been omitted from FIG. 1 for the sake of simplicity but will be apparent to persons of ordinary skill in the art. The configuration shown in FIG. 1 is an example configuration, which was chosen purely for the sake of conceptual clarity. In alternative embodiments, any other suitable configurations can also be used.

Figure 2:
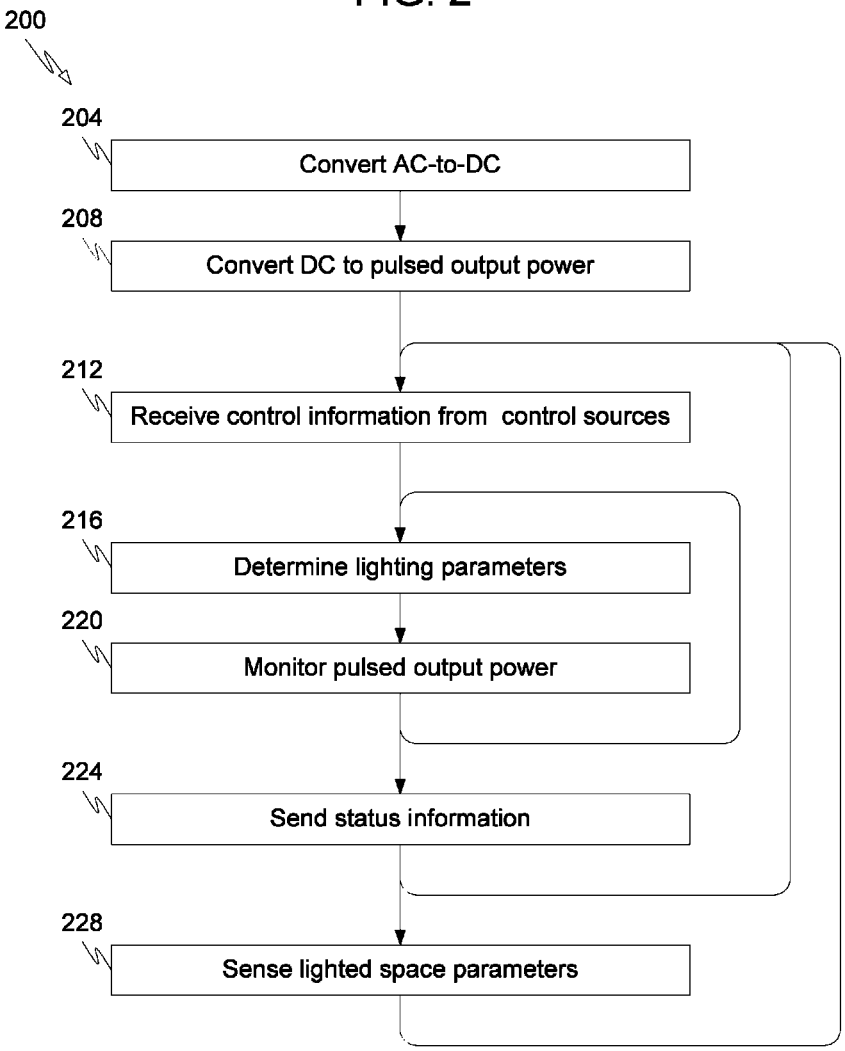
FIG. 2 is a flowchart that schematically illustrates a method of controlled driving of LEDs, in accordance with an embodiment of the present invention.

FIG. 2 shows a flowchart 200 which schematically illustrates a method of controlled driving of LEDs, in accordance with an embodiment of the present invention. The flowchart begins with a converting step 204, wherein AC/DC converter 112 converts AC voltage 108 to a DC voltage at its output. In a converting step 208, each LED driver 116 converts the DC voltage to a pulsed output power whose duty-cycle is modulated by a Pulse Width Modulation (PWM) technique for achieving a required lighting intensity. In a receiving step 212, local controller 128 receives control information from various controlled sources as described above. In an determining step 216, local controller 128 determines the lighting parameters, as duty cycle and intensity, of the pulsed output power at the outputs of LED drivers 116 for achieving a required lighting of LEDs 124. In a monitoring step 220, V/I monitoring circuitry 120 monitor the driving voltages and currents supplied by LED drivers 116 to LEDs 124. Local controller 128 adjusts, according the monitored values, the lighting parameters, which is depicted by a return loop from step 220 to step 216.

In a sending step 224, local controller 128 sends status information, such as dimming angle, to remote controller 144, which commands the local controller while taking into account this status information as explained above. This is depicted by a return loop from step 224 to step 212. In a sensing step 228, one or more sensors sense various parameters in the space to be lighted, as described above. The output signaling of these sensors constitutes part of the overall control information according to which local controller 128 controls LED drivers 116. This is depicted by a return loop from step 228 to step 212.

The flowchart shown in FIG. 2 is an example flowchart, which was chosen purely for the sake of conceptual clarity. In alternative embodiments, any other suitable flowchart can also be used for illustrating the disclosed method. Method steps that are not mandatory for understanding the disclosed techniques were omitted from FIG. 2 for the sake of clarity.

Although the embodiments described herein mainly address LED lighting, the methods and systems exemplified by these embodiments can also be used in other lighting applications.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art.

The invention claimed is:

1. A controlled light emitting diode (LED) driver comprising:

an AC/DC converter configured to convert an AC voltage at an input thereof to a DC voltage at an output thereof;

one or more LED drivers coupled to said output of said AC/DC converter and configured to convert said DC voltage to a pulsed output power for driving one or more LEDs that serve to provide lighting; and a local controller having a control interface, said control interface configured to receive control information from one or more control sources coupled to said control interface, said local controller further coupled to said one or more LED drivers for controlling the operation of said one or more LED drivers by determining one or more parameters of said pulsed output power based on said control information, wherein said local controller is further configured to send status information to a remote controller, said status information comprising output signaling of at least part of said one or more control sources.

2. The controlled LED driver of claim 1, wherein said one or more LED drivers comprises a voltage source.

3. The controlled LED driver of claim 1, wherein said one or more LED drivers comprises a current source.

4. The controlled LED driver of claim 1, wherein said one or more parameters comprises a duty-cycle.

5. The controlled LED driver of claim 4, wherein said one or more LED drivers comprises a pulse width modulation (PWM) mechanism for determining said duty-cycle.

6. The controlled LED driver of claim 1, wherein said one or more parameters comprises an amplitude.

7. The controlled LED driver of claim 1, said one or more LED drivers comprising a plurality of controlled LED drivers, said one or more LEDs are colored and controlling the operation of said plurality of controlled LED drivers comprises adjusting the pulsed output power of each of the plurality of controlled LED drivers so as to achieve a required resultant lighting color.

8. The controlled LED driver of claim 1, said AC voltage having a dimming angle and said control information comprises said dimming angle.

9. The controlled LED driver of claim 8, wherein said local controller is configured to determine a maximum lighting intensity based on said dimming angle.

10. The controlled LED driver of claim 1, wherein said one or more control sources comprise one or more sensors.

11. The controlled LED driver of claim 10, wherein at least one of said one or more sensors is a motion detector.

12. The controlled LED driver of claim 10, wherein at least one of said one or more sensors is a light detector.

13. The controlled LED driver of claim 10, wherein at least one of said one or more sensors is a photographic means providing information about a space in the vicinity of said one or more LEDs, and controlling the operation of said one or more LED drivers is based on said information about said space.

14. The controlled LED driver of claim 13, wherein said information about said space relates to motion in said space.

15. The controlled LED driver of claim 13, wherein said information about said space relates to lighting in said space.

16. The controlled LED driver of claim 1, wherein said remote controller is a smartphone.

17. The controlled LED driver of claim 1, wherein at least one of said one or more control sources is a dimmer.

18. The controlled LED driver of claim 1, wherein said control interface comprises an audio interface, said one or more control sources comprise a user, and said control information comprises vocal commands issued by said user and received by said audio interface.

19. The controlled LED driver of claim 1, wherein said control interface comprises an audio interface, said one or more control sources comprise a sound source, and said control information comprises sounds issued by said sound source and received by said audio interface.

20. The controlled LED driver of claim 1, wherein said status information comprises a dimming angle of said AC voltage.

21. The controlled LED driver of claim 1, wherein at least one of said one or more control sources is coupled to said control interface though a wireless link.

22. The controlled LED driver of claim 21, wherein said wireless link is a multiple access link.

23. The controlled LED driver of claim 1, said control interface comprising a secure access.

24. A method of controlled driving of light emitting diodes (LEDs) comprising the steps of:

converting an AC voltage to a DC voltage;

converting said DC voltage to one or more pulsed output power signals for driving one or more LEDs;

receiving control information from one or more control sources;

determining one or more parameters of said one or more pulsed output power signals based on said control information; and sending status information to a remote controller, said status information comprising output signaling of at least part of said one or more control sources.

25. The method of claim 24, wherein converting said DC voltage to said one or more pulsed output power signals comprises generating at least one of said one or more pulsed output power signals by a voltage source.

26. The method of claim 24, wherein converting said DC voltage to said one or more pulsed output power signals comprises generating at least one of said one or more pulsed output power signals by a current source.

27. The method of claim 24, wherein said one or more parameters comprise a duty-cycle.

28. The method of claim 24, wherein said one or more parameters comprises an amplitude.

29. The method of claim 24, wherein said one or more LEDs are colored, said one or more pulsed output power signals comprise a plurality of pulsed output power signals and determining said one or more parameters of said plurality of pulsed output power signals so as to achieve a required resultant lighting color.

30. The method of claim 24, said AC voltage having a dimming angle and said control information comprises said dimming angle.

31. The method of claim 30, wherein determining said one or more parameters of said one or more pulsed output power signals comprises determining a maximum lighting intensity based on said dimming angle.

32. The method of claim 24, wherein said one or more control sources comprise one or more sensors.

33. The method of claim 32, wherein at least one of said one or more sensors is a motion detector.

34. The method of claim 32, wherein at least one of said one or more sensors is a light detector.

35. The method of claim 34, wherein said information about said space relates to lighting in said space.

36. The method of claim 32, wherein at least one of said one or more sensors is a photographic means providing information about a space in the vicinity of said one or more LEDs, and determining said one or more parameters of said one or more pulsed output power signals is based on said information about said space.

37. The method of claim 36, wherein said information about said space relates to motion in said space.

38. The method of claim 24, wherein said remote controller is a smartphone.

39. The method of claim 24, wherein at least one of said one or more control sources is a dimmer.

40. The method of claim 24, wherein said control information comprises vocal commands.

41. The method of claim 24, wherein said control information comprises sounds.

42. The method of claim 24, wherein said status information comprises a dimming angle of said AC voltage.

43. The method of claim 24, wherein receiving control information from said one or more control sources is based on a wireless link.

44. The method of claim 43, wherein said wireless link is a multiple access link.

45. The method of claim 24, wherein receiving control information from said one or more control sources comprises a secure access.

* * * * *